United States Patent [19]

Abel et al.

[11] Patent Number: 4,539,353

[45] Date of Patent: Sep. 3, 1985

[54] AQUEOUS COMPOSITION OF POLYMALEIC ACID, SURFACTANTS AND COMPLEXING AGENTS, AND ITS PREPARATION AND USE AS AN ASSISTANT IN THE PRETREATMENT OF CELLULOSE-CONTAINING FIBRE MATERIALS

[75] Inventors: Heinz Abel, Reinach; Christian Guth, Basel, both of Switzerland

[73] Assignee: Ciba Geigy Corporation, Ardsley, N.Y.

[21] Appl. No.: 570,710

[22] Filed: Jan. 13, 1984

[30] Foreign Application Priority Data

Jan. 25, 1983 [CH] Switzerland ..... 397/83

[51] Int. Cl.[3] ..... C08K 5/53

[52] U.S. Cl. ..... 524/123; 524/121; 524/284; 524/354; 524/386; 524/387; 524/400; 524/549; 525/327.4; 525/340; 525/366; 525/384

[58] Field of Search ..... 524/121, 123, 549, 386, 524/284; 354, 400, 387; 525/327.4, 340, 384, 366

[56] References Cited

U.S. PATENT DOCUMENTS

| | | | |
|---|---|---|---|
| 4,207,405 | 6/1980 | Masler, III et al. | 524/414 |
| 4,380,597 | 4/1983 | Erwied et al. | 524/284 |

FOREIGN PATENT DOCUMENTS

| | | |
|---|---|---|
| 1369429 | 10/1974 | United Kingdom . |
| 1411063 | 10/1975 | United Kingdom . |
| 1491978 | 11/1977 | United Kingdom . |
| 2039542 | 10/1982 | United Kingdom . |

*Primary Examiner*—Joseph L. Schofer
*Assistant Examiner*—J. M. Reddick
*Attorney, Agent, or Firm*—Edward McC. Roberts; Kevin T. Mansfield

[57] ABSTRACT

Aqueous compositions which contain a hydrolysed polymaleic anhydride, a complexing agent and a mixture of nonionic and anionic surfactants are suitable for use as assistants in the opening up of cellulose-containing fibre materials.

9 Claims, No Drawings

AQUEOUS COMPOSITION OF POLYMALEIC ACID, SURFACTANTS AND COMPLEXING AGENTS, AND ITS PREPARATION AND USE AS AN ASSISTANT IN THE PRETREATMENT OF CELLULOSE-CONTAINING FIBRE MATERIALS

The present invention relates to aqueous compositions which contain polymaleic acid, surfactants and complexing agents, and to their preparation and use as assistants in the pretreatment of cellulose-containing fibre materials.

The pretreatment of cellulose-containing fibre materials includes, inter alia, the steps of desizing, boiling off or kier-boiling, mercerising and bleaching as well as combinations of these steps into one stage, for example combined desizing and boiling off, boiling off and bleaching and boiling and mercerising.

Boiling off or kier-boiling is to be understood as meaning the boiling of fibre materials in an alkaline liquor under atmospheric pressure at about 100° C. (boiling off) or under pressure at about 140° C. (kier-boiling). The purpose of this treatment is chiefly to dissolve out the cotton wax and the pectins and to remove, from the raw cotton fibres, impurities, for example particles of leaf, fruit pod and seed as well as traces of alkaline earth metals and heavy metals.

However, this dissolving out of impurities from the fibres is not yet satisfactory, so that it is desirable to remove sald Impurities to a greater extend (cracking or breaking up of the fibres). They can then be wetted more efficiently by bleaching and dyeing liquors, which gives more uniform bleaching and dyeing.

It is therefore the object of the present invention to provide a composition which is suitable for use as an assistant in alkaline liquors and confers a powerful cleaning action on these.

The present invention accordingly provides an aqueous composition which contains (a) hydrolysed polymaleic anhydride and/or its salt,
(b) a complexing agent, and
(c) a mixture of a non-ionic and/or an anionic surfactant.

Also part of the subject-matter of the invention are the preparation of this composition, the use of this composition in the pretreatment of cellulose-containing fibre materials, in particular in cracking desizing, bleaching and mercerising as well as in the (combined) cracking and desizing, cracking and bleaching and cracking and mercerising of these materials, and the aqueous liquors used for said processing stages as well as the fibre materials (pre)treated with this liquors.

Component (a) of the composition according to the invention is a partially hydrolysed polymaleic anhydride which can be partly in the form of a water-soluble salt and the molecular weight of which is preferably between 300 and 5,000.

Polymaleic anhydride is a homopolymer of maleic anhydride and can be very easily hydrolysed, for example by heating in water, to form a polymeric product which contains free carboxylic acid groups as well as, depending on the degree of hydrolysis, leftover intact anhydride groups on a carbon main chain. The product is not pure polymaleic acid. The exact structure of the product is not known. In the present description, nevertheless, this polymeric product formed by hydrolysis of polymaleic anhydride is referred to as hydrolysed polymaleic anhydride. It can be prepared by addition polymerisation of a substantially maleic anhydride starting monomer under bulk polymerisation conditions or by solution polymerisation. Maleic anhydride is preferably polymerised in an inert organic solvent, such as toluene or xylene, in the presence of a polymerisation catalyst, in particular a free-radical initiator, such as benzoyl peroxide, ditertiary butyl peroxide or monobutyl hydroperoxide, at temperatures up to 150° C., for example 120° to 145° C. The main chain of the primary polymer is essentially formed by non-hydrolysable bonds. Unreacted monomer and by-products are separated off, and the non-hydrolysed polymer product is then hydrolysed with water or an aqueous base and is then used in this form. If desired, it can also be added to aqueous treatment baths in the non-hydrolysed form.

In the course of the polymerisation or of the subsequent hydrolysis, the polymer can become decarboxylated, so that the measured acid value of the hydrolysed polymaleic anhydride is lower than the theoretical value of 1,143 mg of KOH/g. This decarboxylation, however, does not proceed sufficiently far for the acid value to drop below 350 mg of KOH/g.

It is important that the molecular weight of the hydrolysed polymaleic anhydride is within the low range specified. It is preferable to use polymaleic anhydride having a molecular weight which does not exceed 2,000 and which preferably is within the range from 350 to 1,000.

Further details concerning hydrolysed polymaleic anhydride are described in, for example, GB Nos. 1,369,429, 1,411,063 and 1,491,978 and CH No. 624,256.

As a result of addition of bases to the hydrolysed polymaleic anhydride, some of the latter's carboxyl groups are in the form of, for example, alkali metal carboxylate or ammonium carboxylate groups. Suitable alkali metal salts are in particular the sodium and potassium salts, and suitable ammonium salts are preferably ammonium ($NH_4+$), alkylammonium and alkanolammonium salts, for example the trimethylammonium, monoethanolammonium, diethanolammonium and triethanolammonium salts. Sodium and ammonium ($NH_4+$) salts are particularly suitable.

Component (a) is generally in the form of an aqueous, approximately 40 to 60 percent by weight, solution. The composition according to the invention contains 1.5 to 20, preferably 5 to 20, percent by weight of component (a).

A suitable component (b), namely a complexing agent, is, in particular, any oligomeric phosphonic acid ester and/or polyhydroxy compound. The oligomeric phosphonic acid esters are preferably of the formula

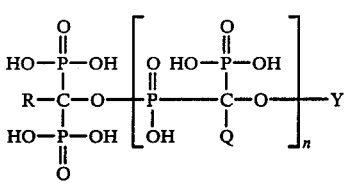

(1)

in which Y is hydrogen or —COT, R, Q and T are each alkyl having 1 to 4 carbon atoms, and n is 1 to 16.

Alkyl radicals R, Q and T in the compounds of the formula (1) are isobutyl, preferably isopropyl, especially n-butyl and n-propyl and in particular ethyl and methyl, of which methyl is particularly preferable.

If Y is —CO—T, then T and R are preferably defined in the same way. However, Y is primarily hydrogen. Preferred limits for n are 1 and 16 and in particular 1 and 12, the main constituent of the mixture being oligomers having average values for n of about 5 to 9, preferably about 5 or 6. Compounds of the formula (1) in which n is 1 and 12 to 16, but especially 12, can however be present in the mixture in a low concentration.

Particularly highly suitable oligomers are of the formula

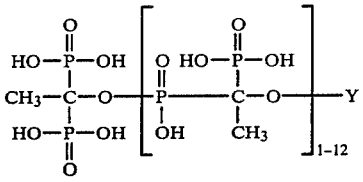

(2)

Suitable polyhydroxy compounds are of the formula

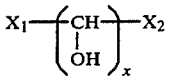

(3)

in which $X_1$ and $X_2$, independently of each other, are each $—CH_2OH$, —CHO or $—CO_2M$ wherein M is hydrogen or an alkali metal, and x is 2 to 5, preferably 2 to 4. A suitable compound of the formula (3) is, for example, glucose. Further preferred compounds of the formula (3) are the hydroxycarboxylic acids of the formula

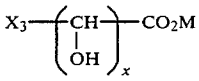

(4)

and

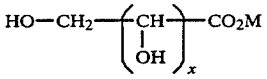

(5)

in which M and x are as defined above, and $X_3$ is $—CH_{20}H$ or —CHO, or lactones of these hydroxycarboxylic acids. Gluconic acid and its alkali metal salts, preferably sodium salts, and also the γ-lactone of gluconic acid give particularly good results. The compositions according to the invention can preferably contain up to 20 percent by weight of the polyhydroxy compounds of the formula (3) or (4), and it has been found to be advantageous to use these compounds in the pure form or in the form of a solution up to 50, in particular 35, % by weight. The compositions according to the invention preferably contain 5 to 20 percent by weight of complexing agent of the formula (1) and/or (3).

The non-ionic surfactant in component (c) is, in the main, a fatty alcohol ethoxylate, alkylphenol ethoxylate and/or fatty acid ethoxylate wherein the fatty acid radicals preferably contain 8 to 18 carbon atoms and the alkyl radicals preferably contain 6 to 12 carbon atoms. The number of ethylene oxide units in the fatty acid and fatty alcohol ethoxylates is preferably between 1 and 40 and that in the alkylphenol ethoxylates is generally between 5 and 20 (inclusive). Particularly suitable fatty alcohol ethoxylates contain 12 to 18 carbon atoms in the fatty acid radical and about 2 to 10 ethylene oxide units. The alkyl radicals in the alkylphenol ethoxylates preferably contain 8 or 9 carbon atoms. They also contain at least 5, preferably 7 to 12, ethylene oxide units in order to ensure that they are freely or very soluble in water. Fatty acids having preferably 12 to 17 carbon atoms are therefore preferably used in the form of relatively highly ethoxylated surfactants. They contain about 5 to 35 ethylene oxide units. Component (c) preferably contains a combination of non-ionic surfactants, for example a mixture of a fatty alcohol ethoxylate and a fatty acid ethoxylate, which preferably accounts for 20 to 80 percent by weight of component (c).

Preferred anionic surfactants in component (c) belong to the group of alkylbenzenesulfonates, alkanesulfonates, olefinesulfonates, fatty alcohol sulfates and/or sulfated fatty alcohol ethoxylates which preferably contain 10 to 24 carbon atoms. Component (c) is preferably a mixture of said anionic surfactants.

However, a particularly suitable component (c) is a mixture of said non-ionic and anionic surfactants, for example a mixture of a fatty acid ethoxylate, fatty alcohol ethoxylate and alkanesulfonate. The anionic and non-ionic surfactant content in component (c) is normally 20 to 80 percent by weight. The composition according to the invention preferably contains in total 5 to 50 percent by weight of component (c).

It is advisable to add to the compositions according to the invention a defoaming and/or deaerating agent as component (d), in order to avoid troublesome foaming. Suitable for this purpose are in particular higher alcohols, for example isooctyl alcohol, siloxanes, for example polydimethylsiloxane, preferably mixed with highly disperse silicas, or even mixtures of said alcohols and siloxanes. These components can generally account for 0.1 to 0.5 percent by weight of the compositions.

The preparation of the compositions according to the invention is commenced by first of all dissolving the surfactants which are solid at room temperature (alkanesulfonates, fatty alcohol sulfates and alkylbenzenesulfonates) in hot water by stirring. This takes 1 to 2 hours, depending on the degree of division of the solid surfactants used, the water preferably being at 70° to 80° C. When the surfactants have dissolved, the resulting solution is allowed to cool down, which can take half an hour to 5 hours, depending on the size of the batch. Thereafter any remaining liquid surfactants, the base- or $H_2O$-hydrolysed polymaleic anhydride, and the complexing agent are added to the solution with stirring in that order.

The compositions according to the invention thus preferably contain 1.5 to 20 percent by weight of a base-or water-hydrolysed polymaleic anhydride, 2.5 to 25 percent by weight of a complexing agent, 5 to 50 percent by weight of a mixture of non-ionic and anionic surfactants, 0 to 2 percent by weight of a defoaming and/or deaerating agent, and 3 to 91 percent by weight of water.

Particularly suitable compositions contain 5 to 20 percent by weight of a base- or water-hydrolysed polymaleic anhydride, 5 to 20 percent by weight of a complexing agent, 5 to 50 percent by weight of a mixture of a non-ionic and an anionic surfactant, optionally 0.1 to 0.5 percent by weight of a defoaming and/or deaerating agent, and 9.5 to 85 percent by weight of water.

Particularly good results are obtained with compositions which contain 5 to 15 percent by weight of a base- or water-hydrolysed polymaleic anhydride, 5 to 15 percent by weight of a complexing agent, 25 to 50 percent by weight of a mixture of a non-ionic and/or an anionic surfactant, and 20 to 65 percent by weight of water.

The percentages by weight are based on the active substance content.

Aqueous liquors for pretreating cellulose-containing materials preferably contain 0.1 to 5 percent by weight of compositions of components (a) to (c) and optIonaIIy (d) in the specified mixing ratios and 0.05 to 30 percent by weight of an alkali metal hydroxide, preferably sodium hydroxide or potassium hydroxide, which is generally used in the form of a 30 to 35% aqueous solution. However, the alkali metal hydroxide can also be used in the form of a solid.

Aqueous liquors with which the cellulose-containing fibre material can also be desized at the same time additionally contain an oxidising agent as component (e). These oxidising agents are preferably peroxodisulfates, for example sodium peroxodisulfate and hydrogen peroxide and mixtures of these compounds. Preferably 0.2 to 0.8, in particular 0.2 to 0.5, percent by weight of oxidising agent (mixture) is used in the liquor.

The compositions according to the invention can also be used as cracking agents in bleaching processes, in particular cold storage bleaching processes. They furthermore have a stabilising action on the peroxides used in these bleaching processes. The bleaching liquors then preferably contain 1.0 to 8.0 percent by weight of an alkali metal hydroxide, 0.2 to 3.0 percent by weight of a composition of 1.5 to 20 percent by weight of a base- or water-hydrolysed polymaleic anhydride, 2.5 to 25 percent by weight of a complexing agent, 5 to 50 percent by weight of a mixture of a non-ionic and/or an anionic surfactant, 0 to 2 percent by weight of a defoaming and/or deaerating agent and 3 to 91 percent by weight of water, and 0.1 to 3.0 percent by weight of an oxidising agent.

Examples of possible oxidising agents are hydrogen peroxide, which can be in a combination with a peroxodisulfate, such as sodium peroxodisulfate, and sodium hypochlorite, which, if used, is usually complemented by sodium carbonate.

The compositions according to the invention are also suitable for use as an additive to the stabilising and washing stages downstream of the actual mercerisation. Materials thus treated have been found to be very absorbent and can be dyed at once, namely without going through, for example, the boiling off stage.

The liquors used in the stabilising and washing stage preferably contain 1.0 to 6.0 percent by weight of sodium hydroxide (solid) and 0.2 to 2.0 percent by weight of a composition of 1.5 to 20 percent by weight of a salt of a base- or water-hydrolysed polymaleic anhydride, 2.5 to 25 percent by weight of a complexing agent, 5 to 50 percent by weight of a mixture of a non-ionic and/or an anionic surfactant, 0 to 2 percent by weight of a defoaming and/or deaerating agent, and 3 to 91 percent by weight of water.

The application method for the alkaline pretreatment of cellulose-containing fibre materials using the compositions according to the invention is carried out in accordance with methods known per se. These methods can be divided into treatments in short or long liquors, on the one hand, and the impregnating or exhaust methods on the other.

For example, the material can be subjected to a treatment of about 1 to 3 hours in liquors having a liquor ratio of about 3:1 to 40:1 at a treatment temperature of about 80° to 100° C. under standard conditions, i.e. under atmospheric pressure. In the so-called HT (high-temperature) methods, temperatures of up to 140° C. are used.

The impregnating methods involve impregnating the material to be treated by dipping it into a padding liquor and then squeezing off excess liquor, the padding liquor generally being at 20° to 70° C. The chemicals applied by the impregnation then act on the textile material in a process in which the duration of action, the temperature and the concentration of the chemicals are directly related and the chosen conditions depend on the nature of the fibre material and especially on the available equipment.

For instance, the impregnated fibre material is as a rule stored in the form of a web or rope at, for example, room temperature (15° to 25° C.) for a prolonged period, for example 24 hours, or is treated, depending on the apparatus used, at elevated temperatures, for example at about 100° to 130° C. for about 1 to 10 minutes in steamers, at about 95° to 100° C. for about 5 to 30 minutes in open-width J boxes, at about 90° to 100° C. for about 45 minutes to 2 hours in standard-width J boxes or conveyors, at about 80° to 90° C. for about 2 to 4 hours in the pad-roll process, or at about 50° to 80° C. for about 3 to 6 hours in pad-batch processes, the general rule being that the higher the temperature the shorter the chosen duration of treatment.

Afterwards the fibre materials can be thoroughly rinsed, first of all with boiling hot water, then with warm water and finally with cold water, can be neutralised, if necessary, with, for example, hydrochloric acid or acetic acid, and can then be dried.

The cellulose-containing material which is treated in accordance with the invention can be at very different stages of processing, for example in the form of loose material, yarn or woven or knitted fabric. As a rule this material is always textile fibre materials which are made of pure textile cellulose fibres or of mixtures of textile cellulose fibres with textile synthetic fibres.

Examples of possible cellulose fibres are those made of regenerated cellulose, for example viscose staple, and those made of natural cellulose, for example hemp, linen, jute and especially cotton, and examples of synthetic fibres are those made of polyester or nylon.

Fabrics made of cotton or regenerated cellulose or blend fabrics made of cotton and polyester or of cotton and nylon are particularly highly suitable for treatment in accordance with the invention, woven and knitted cotton fabrics being of primary interest.

Owing to the more powerful cleaning action of the aqueous liquors according to the invention, the fibre materials treated therewith are distinguished by their low ash content and residual fat content as well as by a whiteness which is higher than that of untreated materials. Furthermore, the use of the compositions according to the invention makes it possible for the alkaline liquors to penetrate particularly efficiently into the fibre material. This effect is particularly advantageous in the case of continuous processes, since these processes can then be operated at a high speed of throughput.

In the following examples the parts and percentages are by weight unless stated otherwise.

Method of Preparing Component (a) (Partial Ammonium Salt of a Hydrolysed Polymaleic Anhydride)

Method A:

100 parts of maleic anhydride in 100 parts of xylene are heated to 120° C., and a solution of 20 parts of ditertiary butyl peroxide in 50 parts of xylene is added in the course of 15 minutes. The reaction mixture is heated up further, to 130° C., and is held at this temperature for 5 hours. Both the heating and the stirring are discontinued, and the product of the polymerisation is allowed to separate out. When the reaction mixture has cooled down to 85° C., the lower, polymer layer is separated from the upper, xylene layer. This gives 81 parts of polymerisation product.

The polymerisation product is diluted with 15 parts of 2-butanone or 1,4-dioxane and is further purified as follows: the polymer is precipitated by adding the solution of the polymer to 430 parts of toluene in a high-speed homogenising apparatus. Filtering off and drying at 50° C. in vacuo gives 78 parts of pulverulent polymer.

Measurement in 2-butanone by means of a vapour pressure osmometer shows the polymaleic anhydride obtained to have a molecular weight of 580.

20 parts of the polymaleic anhydride are heated at 90° C. in 20 parts of water for 30 minutes, whereupon the solution obtained is cooled down to 30° C. and filtered. This gives a solution having a solids content of 53%. Potentiometric titration of a sample of the hydrolysed polymer against potassium hydroxide gives an acid value of 560 mg of KOH/g.

The hydrolysed polymaleic anhydride solution then has added to it 4.5 parts of a 25% aqueous ammonia solution and sufficient water for a 50% aqueous solution of the hydrolysed polymaleic anhydride, which is partly in the form of the ammonium salt, to form.

EXAMPLE 1

Desized grey-state cotton fabric is impregnated with a liquor which contains per liter 40 g of sodium hydroxide and 10 g of a cracking agent composed of 20 parts ot a hydrolysed polymaleic anhydride, 20 parts of the compound of the formula (2), 10 parts of a mixture of 500 parts of an adduct of soya bean oil and 36 moles of ethylene oxide, 50 parts of isobutanol and 450 parts of water, and 50 parts of a mixture of 9.8 parts of an adduct of a $C_{12}$ alcohol and 4 moles of ethylene oxide, 30.3 parts of pentadecanesulfonic acid (sodium salt) and 59.9 parts of water, and is brought to a 100% liquor pick-up. The fabric is then steamed at about 100° C. for 3 minutes, is washed with boiling and then cold water, is neutralised with acetic acid, and is dried. The fabric thus obtained is highly absorbent and virtually free of iron.

The procedure is repeated, except that the liquor has added to it, per liter, 0.5 g of iron(III) chloride hexahydrate. The treated fabric is again highly absorbent and is virtually free of iron. This demonstrates that the opening-up agent according to the invention is a very effective complexing agent for any trace iron present, for example, in the raw cotton fibre or even in the water used, and in this way prevents the iron from being carried over into, for example, the bleaching bath (where iron catalytically decomposes hydrogen peroxide and thus reduces the bleaching power of the bleaching bath).

Iron left over or in the fibre is detected by reaction with a potassium ferrocyanide solution (blue colour) and assessed by means of the British Standard (B.S. 2663: 1961) Grey Scale for Assessing Staining. The material treated with the composition according to the invention is assessed as 4–5 on this scale (material treated without assistant: 2–3).

EXAMPLE 2

Sized grey-state cotton fabric is impregnated with a liquor which contains per liter 40 g of sodium hydroxide, 10 g of the cracking agent used in Example 1, 4 g of sodium peroxodisulfate and 0.5 g of iron(III) chloride hexahydrate, and is brought to a 100% liquor pick-up. The fabric is then steamed at about 100° C. for 3 minutes, is washed with boiling and then with cold water, is neutralised with acetic acid, and is dried. The fabric thus obtained is desized (TEGEWA violet scale: 7–8), is very absorbent and is virtually free of iron (grey scale: 4–5; material treated without assistant: 2).

EXAMPLE 3

Desized grey-state cotton fabric is treated for 30 minutes at a liquor ratio of 30:1 in a boiling liquor which contains per liter 40 g of sodium hydroxide, 10 g of the cracking agent used in Example 1 and 0.05 g of iron(III) chloride hexahydrate, is washed with boiling and then with cold water, is neutralised with acetic acid, and is dried. The fabric thus obtained is very absorbent and virtually free of iron (grey scale: 4; material treated without assistant: 2).

EXAMPLE 4

Starch-sized grey-state cotton fabric is impregnated with a liquor which contains per liter 40 g of sodium hydroxide, 40 ml of hydrogen peroxide (35%) and 10 g of a composition of 5 parts of a hydrolysed polymaleic anhydride, 9.25 parts of the compound of the formula (2), 7.75 parts of sodium gluconate, 2.7 parts of magnesium chloride hexahydrate, 17.5 parts of sodium dodecylsulfate, 7.5 parts of an adduct of 1 mole of nonylphenol and 9 moles of ethylene oxide, and 50.3 parts of water, and is brought to a 90% liquor pick-up. The fabric thus impregnated is packed airtight into a sheet of plastic and is stored at room temperature for 24 hours. The fabric is then washed in a bath which contains per liter 4 g of sodium hydroxide, is then rinsed hot and cold, is neutralised, and is dried. The fabric obtained has been desized (TEGEWA violet scale: 7).

EXAMPLE 5

Starch-sized grey-state cotton fabric is impregnated with a liquor which contains per liter 25 g of sodium hydroxide, 12 ml of hydrogen peroxide (35%), 0.5 g of magnesium chloride hexahydrate and 5 g of a composition of 12 parts of a hydrolysed polymaleic anhydride, 7.5 parts of sodium gluconate, 20 parts of the sodium salt of the sulfuric acid ester of 1 mole of lauryl alcohol and 2.5 moles of ethylene oxide, 5 parts of an adduct of 1 mole of primary $C_9$–$C_{11}$ alcohol and 4 moles of ethylene oxide, and 55.5 parts of water, and is brought to a 90% liquor pick-up. The impregnated fabric is then steamed at 100° to 102° C. and immediately thereafter washed in a bath which contains 2 g of sodium hydroxide per liter. It is then rinsed hot and cold, neutralised and dried. The fabric obtained has been desized (TEGEWA violet scale: 8).

EXAMPLE 6

(Cracking Agent in the Cold Storage Bleaching Method)

Starch-sized grey-state cotton fabric is impregnated with a liquor which contains per liter 30 g of sodium hydroxide, 50 ml of hydrogen peroxide (35%), 4 g of sodium peroxodisulfate and 15 g of a composition of 10 parts of a hydrolysed polymaleic anhydride, 5.17 parts of the compound of the formula (2), 7.83 parts of sodium gluconate, 1.8 parts of magnesium chloride hexahydrate, 10 parts of an adduct of 1 mole of primary $C_9$–$C_{11}$ alcohol with 4 moles of ethylene oxide, 16.66 parts of the sodium salt of pentadecane-1-sulfonic acid and 48.54 parts of water, and is brought to a 90% liquor pick-up. The fabric is then packed airtight into a sheet of plastic and is stored at room temperature for 24 hours. The fabric is then washed at the boil in a bath which contains per liter 2 g of a composition of 15 parts of hydrolysed polymaleic anhydride, 6 parts of the compound of the formula (2), 4 parts of sodium gluconate, 25 parts of the sodium salt of pentadecane-1-sulfonic acid, 15 parts of an adduct of 1 mole of primary $C_9$–$C_{11}$ alcohol with 4 moles of ethylene oxide, and 35 parts of water. It is then neutralised, rinsed and dried. On the CIBA-GEIGY whiteness scale the grey-state fabric has a measurement of −66 and the pretreated fabric has a measurement of 43.

The addition of said composition to the washing bath markedly increases the rewettability of the fabric. If the fabric is pretreated as described, a check on rewettability gives a wicking height of 24 mm. In contrast, the wicking height is only 5 mm if the fabric is treated as described but without said addition in the washing bath.

EXAMPLE 7

(Peroxide-Stabilising Action in the Cold Storage Bleaching Process)

A bleaching liquor is prepared to contain per liter 30 g of sodium hydroxide, 50 ml of hydrogen peroxide (35%), 4 g of sodium peroxodisulfate, 0.5 g of magnesium chloride hexahydrate and 10 g of a composition of 7.5 parts of hydrolysed polymaleic anhydride, 5 parts of the compound of the formula (2), 5 parts of sodium gluconate, 20 parts of dodecylbenzenesulfonate, 10 parts of an adduct of 1 mole of 9-octadecenecarboxylic acid and 7 moles of ethylene oxide, and 52.5 parts of water. The peroxide content of this liquor after 24 hours is still as high as 96% of the amount originally present.

Grey-state cotton fabric is impregnated with said bleaching liquor and brought to a 90% liquor pick-up. The fabric is then packed airtight in a sheet of plastic and left for 24 hours, is then washed at the boil, hot and cold, is neutralised, is rinsed and is dried. On the CIBA-GEIGY whiteness scale the grey-state fabric has a measurement of −66 and the bleached fabric has a measurement of 41.

EXAMPLE 8

Starch-sized grey-state cotton fabric is impregnated with a liquor which contains per liter 60 g of sodium hydroxide, 5 g of sodium peroxodisulfate and 10 g of a composition of 15 parts of hydrolysed polymaleic anhydride, 10 parts of the compound of the formula (2), 4 parts of sodium gluconate, 30 parts of the sodium salt of pentadecane-1-sulfonic acid, 15 parts of an adduct of 1 mole of primary $C_9$–$C_{11}$ alcohol and 4 moles of ethylene oxide, and 26 parts of water, and is brought to a 90% liquor pick-up. The impregnated fabric is then steamed at 100° to 102° C. for 3 minutes and is then washed at the boil in a liquor which contains 2 g of said composition per liter. It is then washed hot and cold, neutralised, rinsed and dried. The degree of desizing as measured by the TEGEWA violet scale is 7 (1 for the untreated grey-state fabric), and the whiteness as measured by the CIBA-GEIGY whiteness scale has risen from −63 to −22. Furthermore, the treated fabric, which had no hydrophilic characteristics (wicking height: 0 mm) in the grey state, has a much improved rewettability (wicking height: 54 mm).

If a composition of 5 parts of hydrolysed polymaleic anhydride, 15 parts of sodium gluconate, 50 parts of an adduct of 1 mole of primary $C_9$–$C_{11}$ alcohol and 4 moles of ethylene oxide, and 30 parts of water is used in the process described, in place of the composition mentioned, this likewise improves the whiteness (from −63 to −32) and the rewettability (from 0 to 45 mm).

EXAMPLE 9

(Cracking Agent in Hypochlorite Bleaching)

Starch-sized grey-state cotton fabric is impregnated in a liquor which contains per liter 40 ml of sodium hypochlorite solution (14% active chlorine content), 1 g of sodium carbonate (calcined), 10 g of a composition of 10 parts of hydrolysed polymaleic anhydride, 12 parts of the compound of the formula (2), 2.5 parts of sodium gluconate, 50 parts of dodecylbenzenesulfonate and 25.5 parts of water, and sufficient sodium hydroxide for the pH-value of the liquor to be 11.5, and is brought to a 90% liquor pick-up. The fabric is then packed airtight into a sheet of plastic and is stored at room temperature for 1 hour. The fabric is then dechlorinated in a bath which contains 2 g of sodium bisulfite per liter and is washed out at the boil in a washing liquor which contains per liter 2 g of sodium hydroxide and 2 g of said composition. It is then neutralised, rinsed and dried. The degree of desizing is measured by the TEGEWA violet scale is 5. The treated fabric is hydrophilic (drops of water immediately penetrate into the fabric), and the whiteness as measured by the CIBA-GEIGY whiteness scale has risen from −60 to 31.

EXAMPLE 10

(Combined Mercerising and Cracking)

Grey-state cotton tricot is introduced under tension into a mercerising liquor which contains per liter 300 g of sodium hydroxide (solid) and 6 g of a 40% aqueous solution of the sodium salt of 2-ethylhexyl sulfate. After a dwell time of 2 minutes in the mercerising liquor the tricot is treated hot (at about 90° C.) first in a bath which contains per liter 40 g of solid sodium hydroxide and then in a bath which contains per liter 20 g of solid sodium hydroxide. To remove residual alkaline liquor, the tricot is rinsed with hot water (about 90° C.) and neutralised with hydrochloric acid. The tricot thus treated, which originally contains 715 ppm of calcium and 710 ppm of magnesium, now only has a calcium content of 88 ppm and a magnesium content of 59 ppm. However, the hydrophilic characteristics of the tricot have not improved: a drop of water placed on the tricot does not penetrate within 60 seconds (before as well as after the treatment described).

However, if said rinsing baths, which contain per liter 40 and 20 g of solid sodium hydroxide respectively, each have added to them 10 g of a composition of 15 parts of hydrolysed polymaleic anhydride, 10 parts of the compound of the formula (2), 4 parts of sodium gluconate, 30 parts of the sodium salt of pentadecane-1-sulfonic acid, 15 parts of an adduct of 1 mole of primary $C_9$–$C_{11}$ alcohol and 4 moles of ethylene oxide, and 26 parts of water, the alkaline earth metal content of the tricot thus treated drops to 23 ppm of calcium and 23 ppm of magnesium. At the same time the hydrophilic characteristics of the tricot are much improved: a drop of water placed on the tricot immediately penetrates.

Not only the good wettability of the tricot but also the dyeings which can be obtained on it show that using the composition according to the invention at the mercerisation stage can save the conventional boiling-off stage.

What is claimed is:

1. An aqueous composition which contains (a) hydrolyzed polymaleic anhydride and/or its salt, (b) a complexing agent of the formula

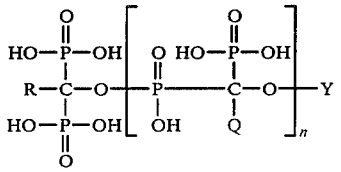

in which Y is hydrogen or —COT, R, Q and T are each alkyl having 1 to 4 carbon atoms, and n is 1 to 16, and/or of the formula

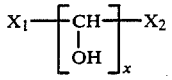

in which $X_1$ and $X_2$, independently of each other, are each $—CH_2OH$, —CHO or $—CO_2M$ wherein M is hydrogen or an alkali metal, and x is 2 to 5 and (c) a non-ionic surfactant, an anionic surfactant or a mixture of a non-iionic and an anionic surfactant.

2. A composition according to claim 1, which contains 1.5 to 20 percent by weight of a salt of the hydrolyzed polymaleic anhydride, 2.5 to 25 percent by weight of the complexing agent, 5 to 50 percent by weight of one or both of the non-ionic and anionic surfactants, 0 to 2 percent by weight of a defoaming and/or a deaerating agent and 3 to 91 percent by weight of water.

3. A composition according to claim 1, wherein component (a) has a molecular weight of 300 to 5,000.

4. A composition according to claim 1, wherein component (c) contains a fatty alcohol ethoxylate, an alkylphenol ethoxylate, a fatty acid ethoxylate or a mixture of these compounds as the non-ionic surfactant.

5. A composition according to claim 1, wherein component (c) contains an alkylbenzenesulfonate, alkanesulfonate, olefinesulfonate, fatty alcohol sulfate, sulfated fatty alcohol ethoxylate or a mixture of these compounds as the anionic surfactant.

6. A composition according to claim 1, wherein component (c) is a mixture of fatty acid ethoxylate, fatty alcohol ethoxylate and alkanesulfonate.

7. A composition according to claim 1, which contains a defoaming and/or deaerating agent as a further component (d).

8. A composition according to claim 1, which contains an oxidising agent as a further component (e).

9. An aqueous liquor for pretreating cellulose-containing fibre materials, which contains 0.05 to 9 percent by weight of an alkali metal hydroxide and 0.1 to 5 percent by weight of a composition according to claim 1.

* * * * *